US006152337A

United States Patent [19]

Petree

[11] Patent Number: 6,152,337

[45] Date of Patent: Nov. 28, 2000

[54] FABRIC PINNING SYSTEM

[76] Inventor: Rebecca I. Petree, 171 Abalone Rd., Venice, Fla. 34293

[21] Appl. No.: 09/501,405

[22] Filed: Feb. 10, 2000

[51] Int. Cl.[7] ..... A41H 43/00

[52] U.S. Cl. ..... 223/1

[58] Field of Search ..... 223/1; 24/706.2, 24/707.1, 708, 708.4, 709.6, 710.7

[56] References Cited

U.S. PATENT DOCUMENTS

| | | | |
|---|---|---|---|
| 1,024,865 | 4/1912 | Reynolds | 24/708 |
| 1,389,604 | 9/1921 | Silverman | 24/708 |
| 1,460,698 | 7/1923 | Zangrilli | 24/708 |
| 2,467,613 | 4/1949 | Davis | 2/21 |
| 2,717,799 | 9/1955 | Jones | 294/25 |
| 2,786,618 | 3/1957 | Emmerling | 233/98 |
| 3,228,033 | 1/1966 | Ames et al. | 2/21 |
| 4,985,038 | 1/1991 | Lyell | 506/148 |
| 5,507,041 | 4/1996 | Wright | 2/21 |
| 5,765,731 | 6/1998 | Callian | 223/101 |

*Primary Examiner*—Bibhu Mohanty
*Attorney, Agent, or Firm*—Joseph N. Breaux

[57] ABSTRACT

A fabric pinning system that includes a rectangular fabric foundation member with two attached pin members and a pin end receiving tube structure. The pin end receiving tube structure includes two inwardly curled side edges. Each inwardly curled side edge forms a pin receiving area sized such that said curled side edge resiliently grips an end of a pin member inserted into an open tube structure end in connection with said pin receiving area.

1 Claim, 2 Drawing Sheets

FABRIC PINNING SYSTEM

TECHNICAL FIELD

The present invention relates to sewing accessories and more particularly to a fabric pinning system that includes a rectangular fabric foundation member with two attached pin members and a pin end receiving tube structure including two inwardly curled side edges, each inwardly curled side edge forming a pin receiving area sized such that the curled side edge resiliently grips an end of a pin member inserted into an open tube structure end in connection with the pin receiving area.

BACKGROUND ART

Straight pins are often used to secure section of fabric together for sewing. Although straight pins perform this task adequately, straight pins have an exposed pointed tip that can stick the seamstress while sewing and stick a person trying on the garment prior to sewing. It would be a benefit, therefore, to have a fabric pinning system that included straight pins and a cover for covering the pointed tips of the straight pins to prevent sticking injuries.

GENERAL SUMMARY DISCUSSION OF INVENTION

It is thus an object of the invention to provide a fabric pinning system that includes a rectangular fabric foundation member with two attached pin members and a pin end receiving tube structure including two inwardly curled side edges, each inwardly curled side edge forming a pin receiving area sized such that the curled side edge resiliently grips an end of a pin member inserted into an open tube structure end in connection with the pin receiving area.

Accordingly, a fabric pinning system is provided. The fabric pinning system includes a rectangular fabric foundation member with two attached pin members and a pin end receiving tube structure including two inwardly curled side edges, each inwardly curled side edge forming a pin receiving area sized such that the curled side edge resiliently grips an end of a pin member inserted into an open tube structure end in connection with the pin receiving area.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
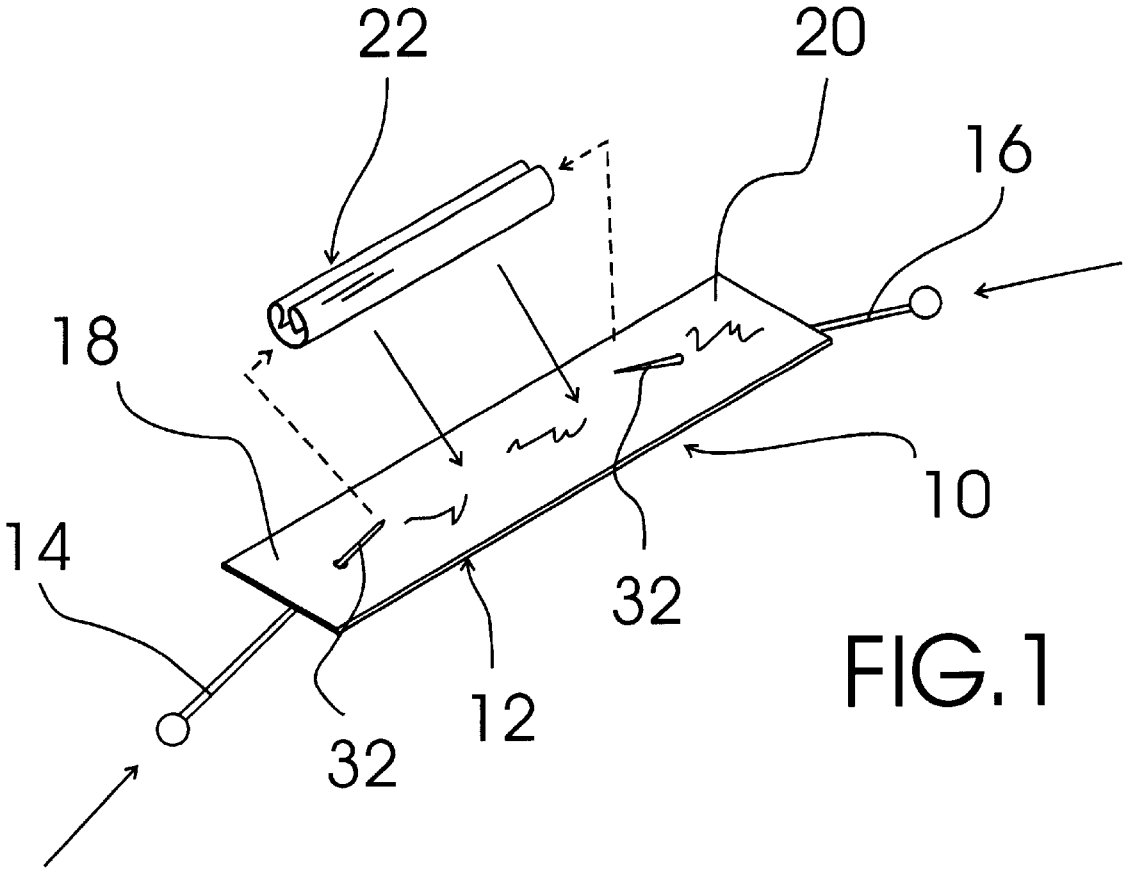
FIG. 1 is a perspective view of an exemplary embodiment of the fabric pinning system of the present invention showing the rectangular fabric foundation member with two attached pin members and the pin end receiving tube structure including two inwardly curled side edges, each inwardly curled side edge forming a pin receiving area sized such that the curled side edge resiliently grips an end of a pin member inserted into the open tube structure end.
Figure 2:
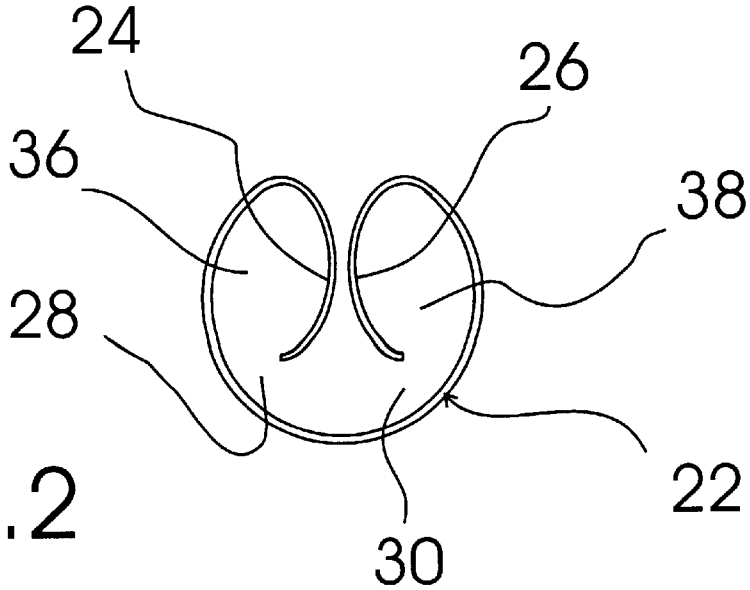
FIG. 2 is a end plan view of the pin end receiving tube structure showing the two inwardly curled side edges forming two pin receiving areas.
Figure 3:
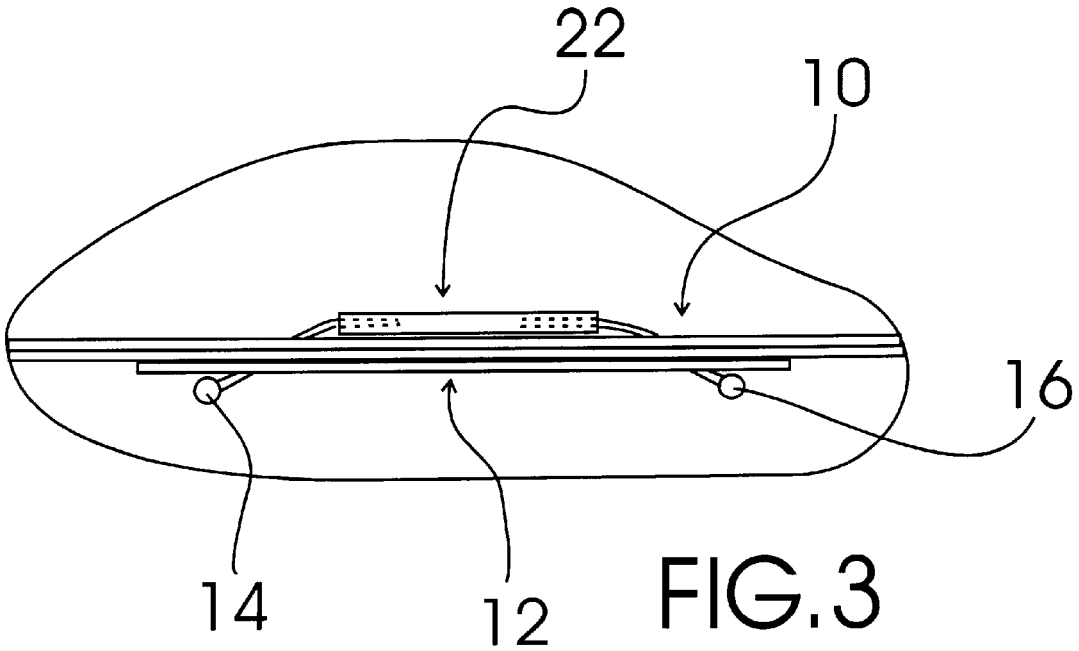
FIG. 3 is a side plan view showing two fabric layers secured together with the exemplary fabric pinning system of FIG. 1.
Figure 4:
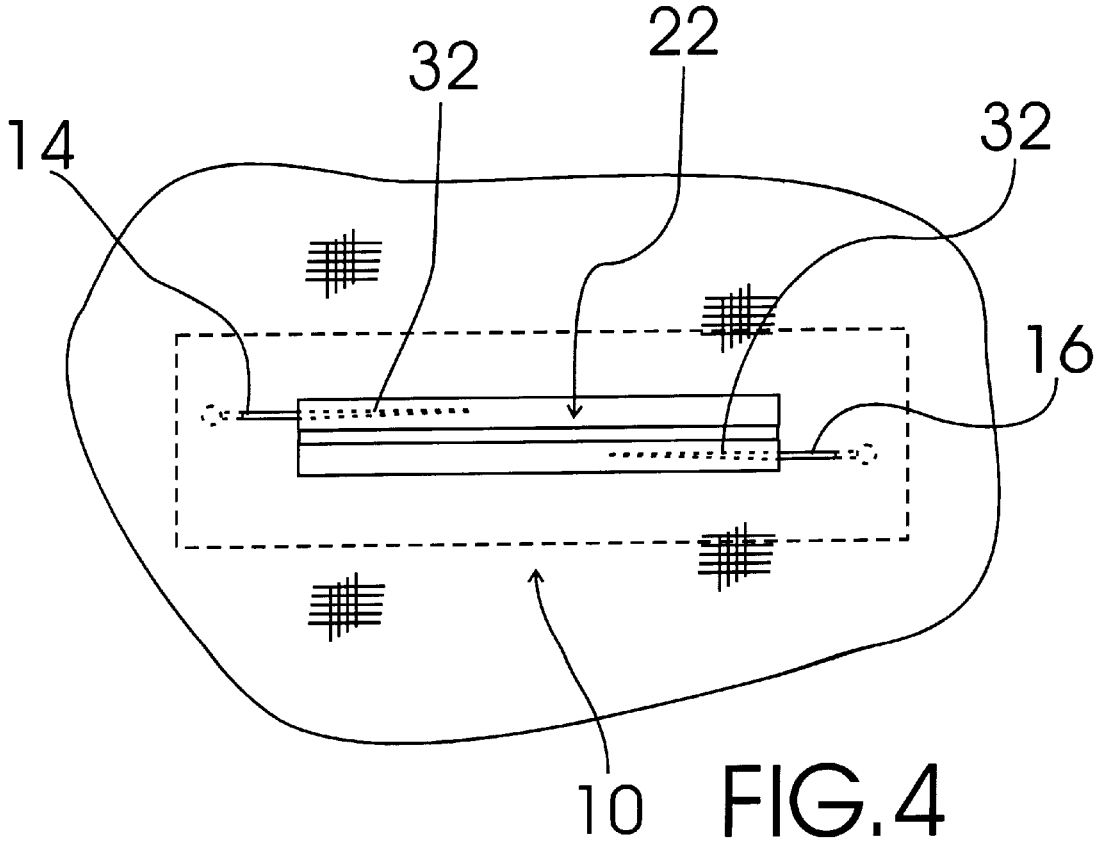
FIG. 4 is a top plan view showing two fabric layers secured together with the exemplary fabric pinning system of FIG. 1.

FIGS. 1–4 show various aspects of an exemplary embodiment of the fabric pinning system of the present invention generally designated 10. Fabric pinning system 10 includes a rectangular plastic fabric foundation member, generally designated 12, having two straight pin members 14,16 attached to opposed side ends 18,20 thereof and a resilient plastic pin end receiving tube structure, generally designated 22, including two inwardly curled side edges 24,26. Each inwardly curled side edge 24,26 forms a pin receiving area 28,30, respectively, sized such that the curled side edge 24,26 resiliently grips an end 32 of a straight pin member 14,16 inserted into an open tube structure end 36,38 in connection with the pin receiving area 28,30.

It can be seen from the preceding description that a fabric pinning system has been provided that includes a rectangular fabric foundation member with two attached pin members and a pin end receiving tube structure including two inwardly curled side edges, each inwardly curled side edge forming a pin receiving area sized such that the curled side edge resiliently grips an end of a pin member inserted into an open tube structure end in connection with the pin receiving area.

It is noted that the embodiment of the fabric pinning system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A fabric pinning system comprising:

a rectangular fabric foundation member with two attached pin members; and a pin end receiving tube structure including two inwardly curled side edges, each inwardly curled side edge forming a pin receiving area sized such that said curled side edge resiliently grips an end of a pin member inserted into an open tube structure end in connection with said pin receiving area.

* * * * *